US011619060B2

(12) United States Patent
Durvasula et al.

(10) Patent No.: US 11,619,060 B2
(45) Date of Patent: Apr. 4, 2023

(54) ROBOTIC POOL CLEANER WITH EXTENDED BRUSH ASSEMBLY

(71) Applicant: ZODIAC POOL SYSTEMS LLC, Carlsbad, CA (US)

(72) Inventors: Kameshwar Durvasula, Garfield, NJ (US); Ethan Hanan, Teaneck, NJ (US); Anthony Meletta, Little Falls, NJ (US)

(73) Assignee: ZODIAC POOL SYSTEMS LLC, Carlsbad, CA (US)

( * ) Notice: Subject to any disclaimer, the term of this patent is extended or adjusted under 35 U.S.C. 154(b) by 148 days.

(21) Appl. No.: 16/807,463

(22) Filed: Mar. 3, 2020

(65) Prior Publication Data

US 2020/0199901 A1 Jun. 25, 2020

Related U.S. Application Data

(63) Continuation of application No. 15/738,995, filed as application No. PCT/US2016/038780 on Jun. 22, 2016, now Pat. No. 10,619,371.

(Continued)

(51) Int. Cl.
*E04H 4/16* (2006.01)
*A46B 13/02* (2006.01)

(52) U.S. Cl.
CPC ..... *E04H 4/1654* (2013.01); *A46B 13/026* (2013.01)

(58) Field of Classification Search
CPC ..... E04H 4/1654; A47L 2201/00

(Continued)

(56) References Cited

U.S. PATENT DOCUMENTS 4,786,334 A 11/1988 Nystroem
5,435,031 A 7/1995 Minami et al.

(Continued)

FOREIGN PATENT DOCUMENTS

EP 2240653 10/2010
WO 2016209973 12/2016

OTHER PUBLICATIONS

U.S. Appl. No. 15/738,995, Non-Final Office Action dated Sep. 9, 2019, 10 pages.

(Continued)

*Primary Examiner* — Laura C Guidotti
(74) *Attorney, Agent, or Firm* — Kilpatrick Townsend & Stockton LLP

(57) ABSTRACT

A self-propelled robotic pool cleaner includes a housing with a lower portion having an inlet and an upper portion having an outlet, the lower and upper portions define an internal chamber therebetween. A filter and a water pump are mounted in the internal chamber for suctioning pool water into the inlet and discharging filtered water through said outlet. Rotationally-mounted elements are mounted to the housing for supporting and guiding said cleaner on a surface of the pool. An arm assembly extends outward from said housing, and a rotary brush assembly is mounted at a distal end of the arm assembly. An electric motor is coupled to at least one of said water pump, the rotationally-mounted elements and the rotary brush. The pool cleaner is configured to continue climbing upward on a pool wall and tell the rotary brush assembly is above the water level and climbs over the pool coping edge propelling said pool cleaner onto the pool deck.

7 Claims, 11 Drawing Sheets

Related U.S. Application Data

Figure 1:
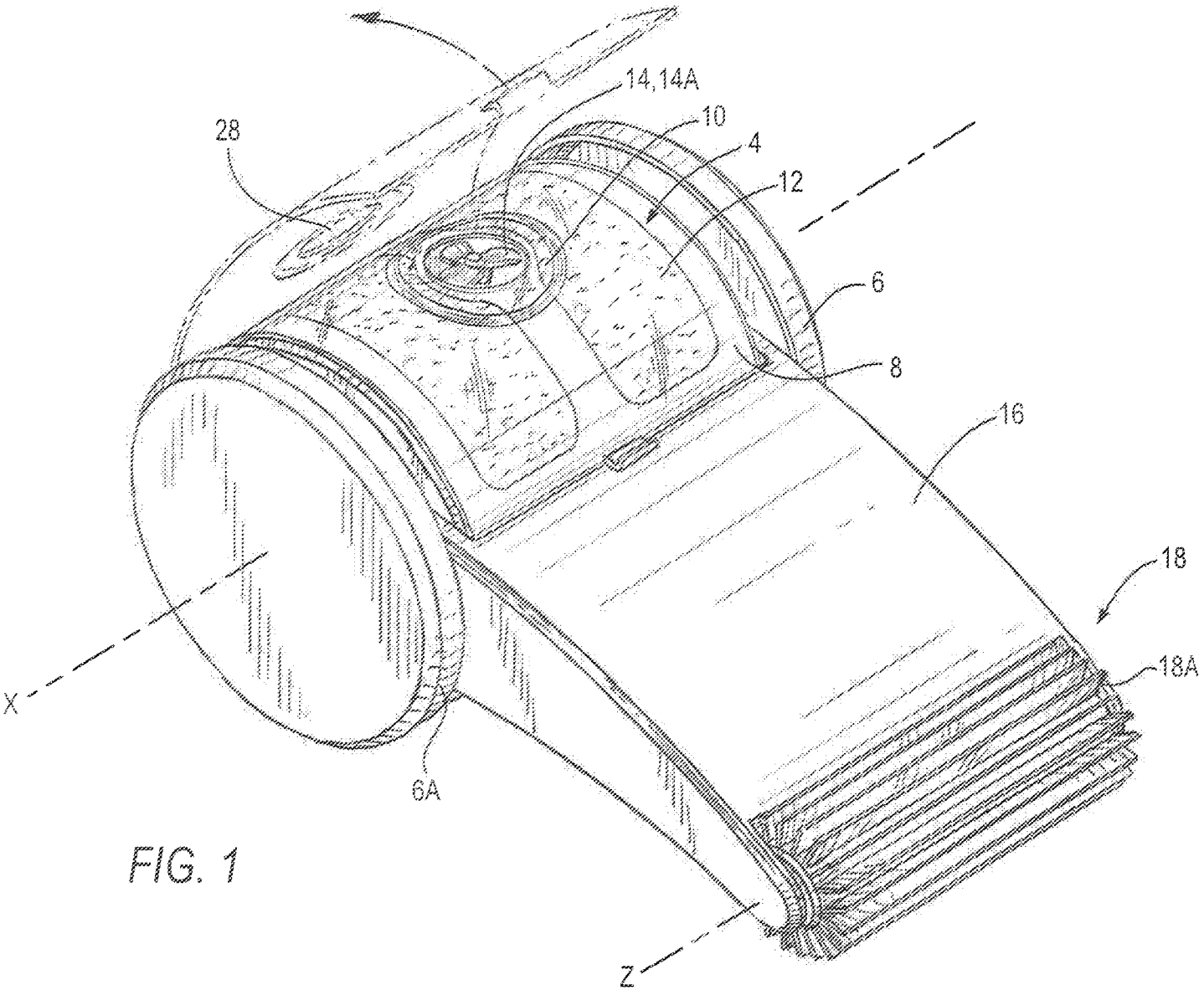

(60) Provisional application No. 62/182,995, filed on Jun. 22, 2015.

(58) Field of Classification Search
USPC ..... 15/1.7
See application file for complete search history.

(56) References Cited

U.S. PATENT DOCUMENTS

| | | | | |
|---|---|---|---|---|
| 6,115,864 | A | 9/2000 | Davidsson et al. | |
| 6,665,900 | B2 * | 12/2003 | Wichmann | E04H 4/1672 15/1.7 |
| 6,782,578 | B1 * | 8/2004 | Rief | E04H 4/1654 15/1.7 |
| 7,520,282 | B2 | 4/2009 | Stoltz | |
| 8,397,330 | B2 | 3/2013 | Pichon et al. | |
| 8,627,533 | B2 * | 1/2014 | Pichon | E04H 4/1654 15/1.7 |
| 10,161,154 | B2 | 12/2018 | Renaud | |
| 10,619,371 | B2 | 4/2020 | Durvasula et al. | |
| 2008/0295264 | A1 | 12/2008 | Hui et al. | |
| 2011/0049023 | A1 | 3/2011 | Hui | |
| 2013/0133144 | A1 | 5/2013 | Erlich et al. | |
| 2013/0133145 | A1 | 5/2013 | Pichon et al. | |
| 2014/0261540 | A1 | 9/2014 | Renaud | |

OTHER PUBLICATIONS

U.S. Appl. No. 15/738,995, Notice of Allowance dated Jan. 21, 2020, 5 pages.
International Application No. PCT/US2016/038780, International Preliminary Report on Patentability dated Jan. 4, 2018, 12 pages.
International Application No. PCT/US2016/038780, International Search Report and Written Opinion dated Sep. 30, 2016, 13 pages.

* cited by examiner

ROBOTIC POOL CLEANER WITH EXTENDED BRUSH ASSEMBLY

CROSS REFERENCE TO RELATED APPLICATIONS

This patent application is a continuation of allowed U.S. patent application Ser. No. 15/738,995, filed Dec. 21, 2017, which claims the benefit of U.S. Provisional Application No. 62/182,995, filed Jun. 22, 2015, and PCT Application No. PCT/US2016/038780, filed Jun. 22, 2016, the contents of which are incorporated by reference herein in their entirety.

FIELD OF THE INVENTION

This invention relates to self-propelled robotic pool cleaners and more specifically to a method and apparatus for cleaning floor and wall surfaces in a pool and filtering water in the pool.

BACKGROUND AND PRIOR ART

This invention pertains to robotic pool cleaners which may be self-propelled by a battery-driven electric motor or controlled by an electrical power/control cable. Such pool cleaners are propelled over a surface of the pool being cleaned which includes bottom, sidewalls and surface water areas.

Pool cleaners pertaining to the present invention have drive or transport wheels for propelling the cleaner, as driven by an internal electric motor powered by batteries. The motor can also drive a water pump which suctions water containing debris into and through internal filters, after which filtered water is discharged. An on-board computer program directs the pool cleaner to traverse a predetermined path along the floor of the pool, and then a path upward along a pool wall. Pool cleaners in this field of art also traverse a path on the surface of the water collecting and filtering debris. Some pool cleaners also utilize discharge in the form of a water jet as part or entirely as the drive means causing the pool cleaner to travel along predetermined or random paths.

OBJECTS AND SUMMARY OF THE INVENTION

Overview: This robotic cleaner driven by its outboard wheels travels in the pool, along the floor of the pool and up the sidewalls. Traction is achieved in part by the friction surfaces of the wheels on pool floor and wall surfaces. Traction is enhanced by the suction of the internal pump pulling the housing toward the traversed surface. Also, this pump suction draws in pool water and entrained debris therein, filters this water and ejects it out of the top of the pool cleaner. An additional feature is an extended brush, whereby an arm extends transversely from the cleaner housing with a rotary brush carried by the arm to dislodge and/or stir up debris forward or upstream of the cleaner's movement. Pool water with this debris is suctioned into the cleaner, which water is filtered and ejected out of the discharge aperture provided in the housing. A further feature of the new pool cleaner is its ability to climb out of the pool by continuing its vertical climb up a pool wall and then proceeding over the edge and out of the pool.

Thus, an object of the present invention is to provide a robotic pool cleaner which includes a rotary brush on a support arm extending forward of the pool cleaner housing to stir up or sweep debris from the floor surface area to the water being suctioned into the pool cleaner for filtering.

Another object is to provide a robotic pool cleaner having a pair of transport wheels on opposite sides of the housing, driven preferably by the same motor which drives the water pump for suctioning water into and through the filters in the housing; however, separate motors may be employed to drive said pump, wheels and/or rotary brush.

An additional object is to provide a robotic pool cleaner having a forward extending support arm supporting a rotary brush and having a drive system whereby the onboard electrical motor through appropriate gear or other power transmission means, drives the transport wheels, the water pump and the forward-extending rotary brush.

A still further object is to provide a robotic pool cleaner having a water inlet at the lower portion of its housing and a filtered water outlet at the upper portion, whereby suction of water into the bottom inlet creates a force drawing the housing toward the pool floor or pool wall surface, and thereby creating greater force between the surfaces of the transport wheels that are in contact with the floor or wall and greater resulting traction of the wheels with the pool surfaces.

Another object is for the rotary brush's support arm to be resiliently hinged to the cleaner housing so that it can pivot upward when the rotary brush encounters an obstacle or bump on the surface traversed, and resiliently pivot back to its normal position.

Another object is for the rotary brush to comprise elements which function both to brush and/or stir debris from the pool's surfaces, but also function as drive elements supplementing the principal drive wheels for propelling the housing.

A further object is for these brush elements to continue driving or rotating to pull the cleaner upward, while climbing a side wall, even when the inlet has risen is above the water level. At this time, continued suction by the pump will draw in air instead of water and thus will have no discharging water jet urging the drive wheels into frictional contact with the wall. However, the brush elements will provide sufficient forward driving force to enable the cleaner to climb up the sidewall and over any coping to exit the pool.

Thus, another object is to provide a pool cleaner as disclosed herein, that can not only traverse pool floor and wall surfaces but can, in its upward travel path, climb over the pool edge and out of the pool.

Another object is to provide a pool cleaner with at least one filter through which inlet water passes, before said water is ejected through the upper portion of the housing.

Another object is to provide a transparent cover whereby a user can see through the cover to determine the status of the filter regarding debris collected therein, An additional object is to provide a power transmission system comprising a driveshaft having at one end a worm gear coupling the drive shaft to the electric motor inside the housing, and at the other end a second worm gear coupling the drive shaft to the brush carried by the support arm.

A yet further object is for the axis of rotation of the brush to be parallel to the axis of rotation of the drive wheels carried by the housing, whereby the brush can cooperate with the drive wheels to propel the cleaner forward.

Additional exemplary embodiments of a self-propelled pool cleaner include:

In one embodiment a self-propelled robotic pool cleaner for cleaning a swimming pool comprising:

a housing including a lower portion having an inlet and an upper portion having an outlet, the lower and upper portions defining an internal chamber therebetween;

a filter mounted in the internal chamber;

a water pump mounted in said internal chamber for suctioning pool water in through said inlet: and discharging filtered water through said outlet;

rotationally-mounted elements mounted to said housing for supporting and guiding said cleaner along a surface of the pool;

an arm extending outward from said housing;

a rotary brush assembly mounted at a distal end of the arm; and at least one electric motor coupled to at least one of said water pump, the rotationally-mounted elements and the rotary brush assembly.

Embodiment 2. The robotic pool cleaner according to Embodiment 1 further comprising an on-board programmable micro-controller having a processor and memory for storing executable programs for operating said cleaner.

Embodiment 3. The pool cleaner according to Embodiment 1, wherein said housing has a front portion, said arm assembly having a proximal end attached at said front portion, and said rotary brush assembly and said rotationally-mounted elements being configured to drive said pool cleaner on a submerged pool surface.

Embodiment 4. The pool cleaner according to Embodiment 1, wherein said rotary brush assembly drives said cleaner up and over a sidewall of the pool when said inlet is positioned above the waterline of the pool water.

Embodiment 5. The pool cleaner according to Embodiment 1, wherein said rotationally-mounted elements rotate about a first axis of rotation and said rotary brush assembly comprises a cylindrical brush that rotates about a second axis of rotation that is spaced apart from and parallel to said first axis of rotation.

Embodiment 6. The pool cleaner according to Embodiment 1, wherein said arm is curved in the shape of an arch.

Embodiment 7. The pool cleaner according to Embodiment 6, wherein said arch defines a concave curve.

Embodiment 8. The pool cleaner according to Embodiment 1 wherein said arm is resiliently hinged to said housing such that said rotary brush assembly is normally biased to maintain contact with a surface of the pool, and will pivot from its normal biasing in a direction away from the pool surface upon encountering an obstacle on the pool surface.

Embodiment 9. The pool cleaner according to Embodiment 1, wherein said arm is resiliently bendable, such that said rotary brush assembly is normally biased to maintain contact with a surface of the pool, and will pivot from its normal biasing in a direction away from the pool surface upon encountering an obstacle on the pool surface.

Embodiment 10. The pool cleaner according to Embodiment 1, wherein said rotationally-mounted elements comprise wheels.

Embodiment 11. The pool cleaner according to Embodiment 1, wherein said at least one electric motor is a single motor mounted in said internal chamber and mechanically connected to the water pump, the rotationally-mounted elements and the rotary brush assembly.

Embodiment 12, The pool cleaner according to Embodiment 1, wherein one of said at least one electric motor is mechanically connected to the rotary brush assembly via a driveshaft extending through said arm.

Embodiment 13. The pool cleaner according to Embodiment 1, wherein said at least one electric motor comprises two electric motors, a first of which being coupled to the water pump and a second of which being coupled to the rotary brush assembly.

Embodiment 14. The pool cleaner according to Embodiment 1, wherein said at least one electric motor comprises three electric motors, a first of which being coupled to the water pump, a second of which being coupled to the rotationally-mounted elements, and a third of which being other coupled to the rotary brush assembly.

Embodiment 15. The pool cleaner according to Embodiment 1, wherein the arm assembly includes ballast positioned along the bottom of the arm assembly.

Embodiment 16. The pool cleaner according to Embodiment 1, wherein the arm includes ballast positioned at the distal end of the arm.

Embodiment 17. A method of cleaning floor and wall surfaces of a pool, comprising:

providing a self-propelled robotic pool cleaner comprising a housing including a lower portion having an inlet and an upper portion having an outlet, the lower and upper portions defining an internal chamber therebetween, a filter mounted in the internal chamber, a water pump mounted in said internal chamber for suctioning pool water in through said inlet and discharging filtered water through said outlet, rotationally-mounted elements mounted to said housing for supporting and guiding said cleaner along a surface of the pool, an arm extending outward from said housing, a rotary brush assembly mounted at a distal end of the arm, and at least one electric motor coupled to at least one of said water pump, the rotationally-mounted elements and the rotary brush assembly;

performing cleaning operation with said rotary brush assembly on a submerged floor surface of said pool as said pool cleaner traverses said floor surface; and climbing up a wall of the pool until said rotary brush assembly is above the waterline where it climbs over the top coping edge of the wall pulls the cleaner over said coping and out of the pool.

Embodiment 18. The method according to Embodiment 17, wherein said climbing the sidewall of the pool comprises expelling a water jet from the cleaner while the housing is submerged in the pool.

Embodiment 19. The method according to Embodiment 17, wherein said climbing the sidewall of the pool comprises rotating said rotary brush assembly when the inlet is positioned above the waterline.

Embodiment 20. The method according to Embodiment 17 comprising the further step of directing said robotic pool cleaner to continue its upward climb on said wall to ascend above the top level of water in said pool and to climb over coping at the edge of the pool.

These objects, advantages and features of the invention will be further understood and appreciated by those skilled in the art by reference to the following written specification, claims and appended drawings.

DETAILED DESCRIPTION OF THE DRAWINGS

Figure 2:
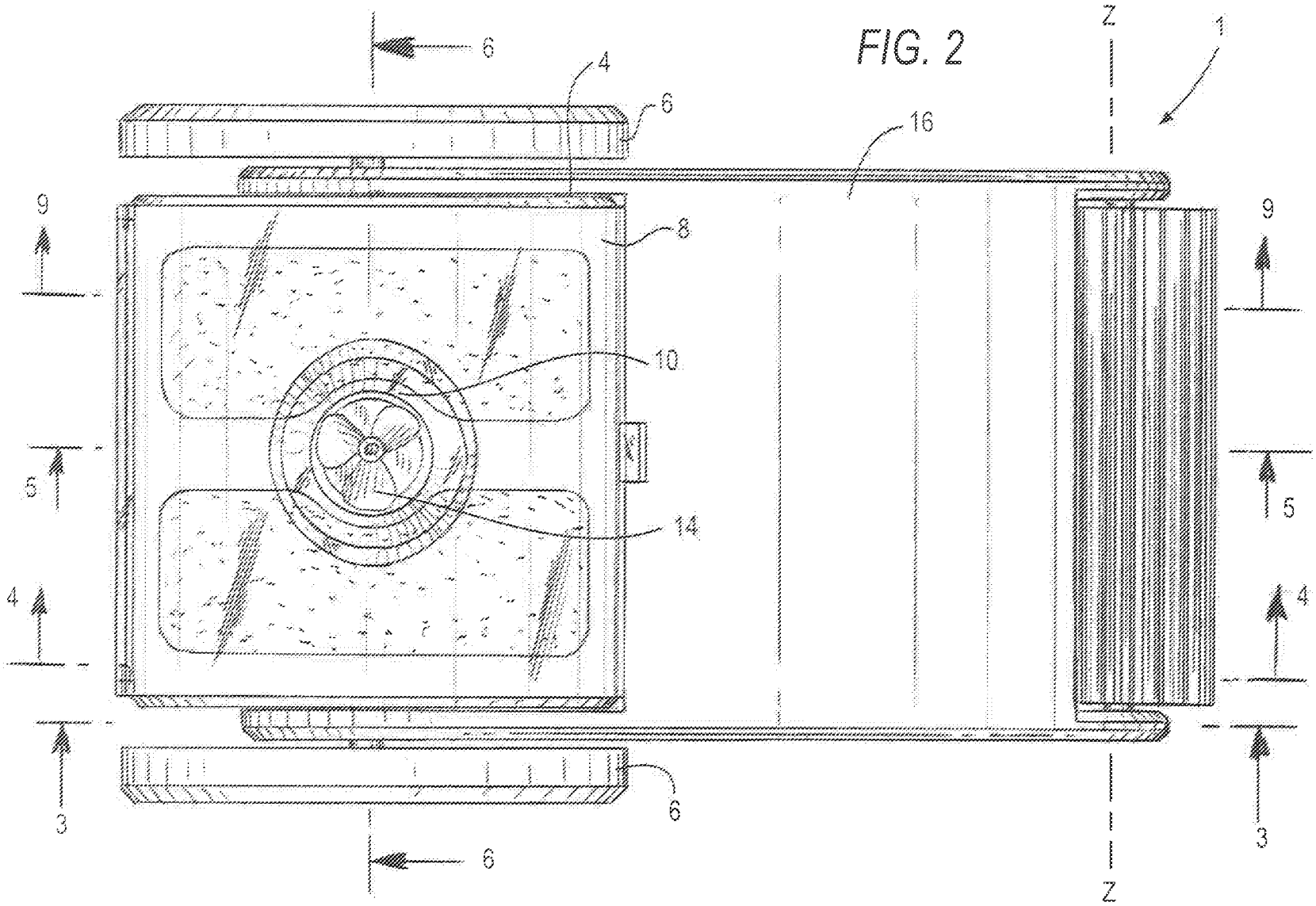
Figure 3:
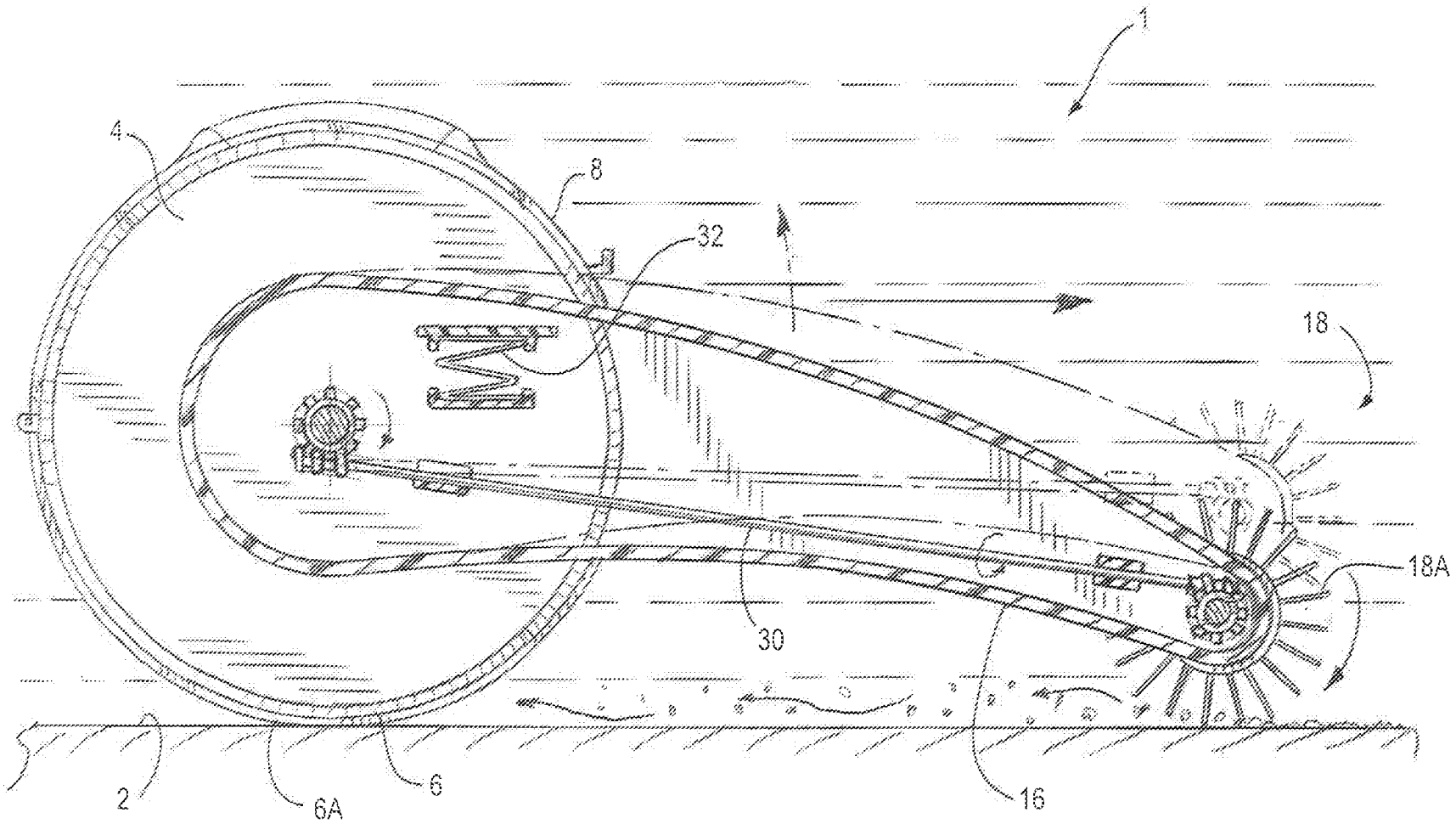
Figure 4:
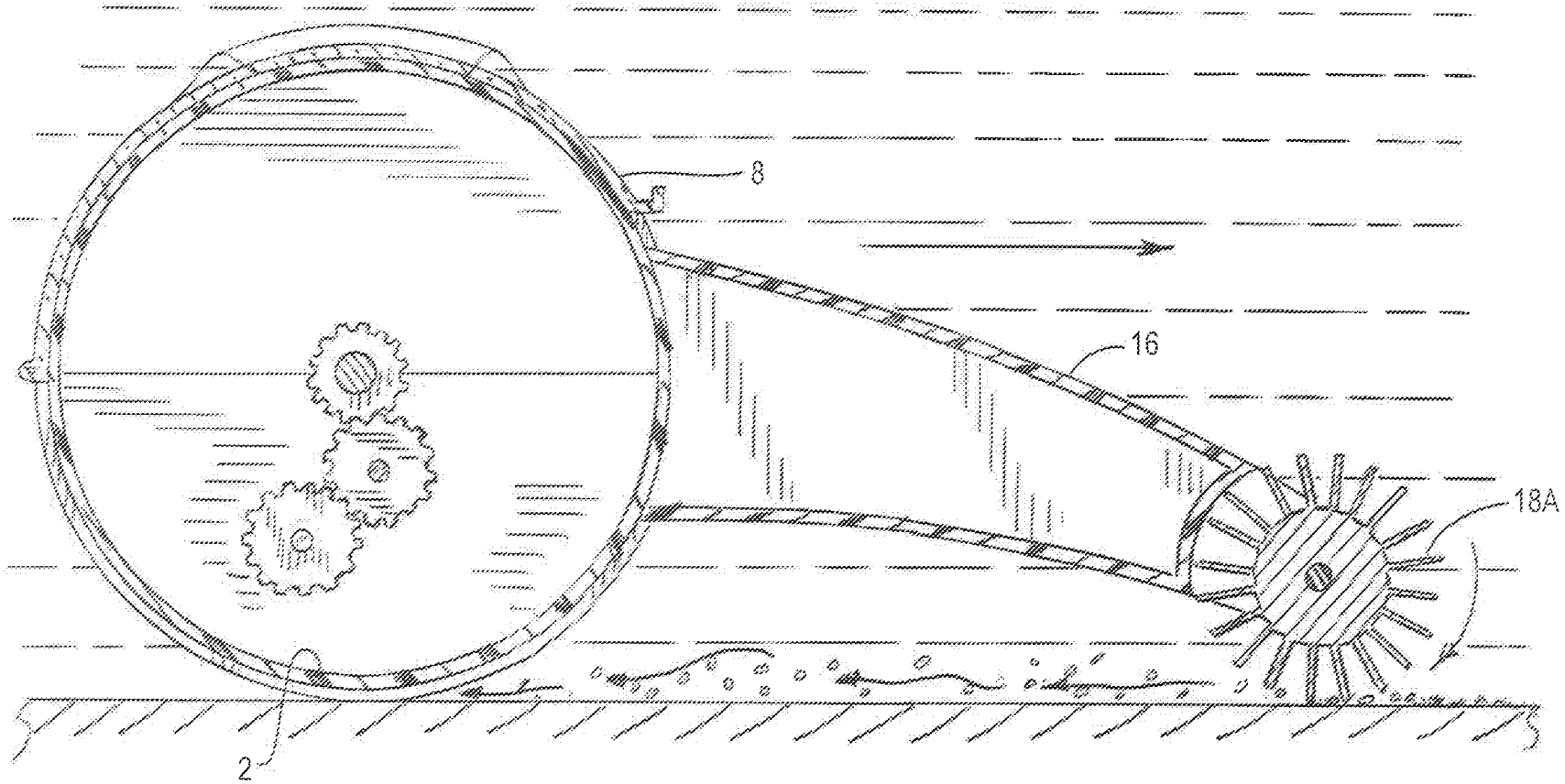
Figure 5:
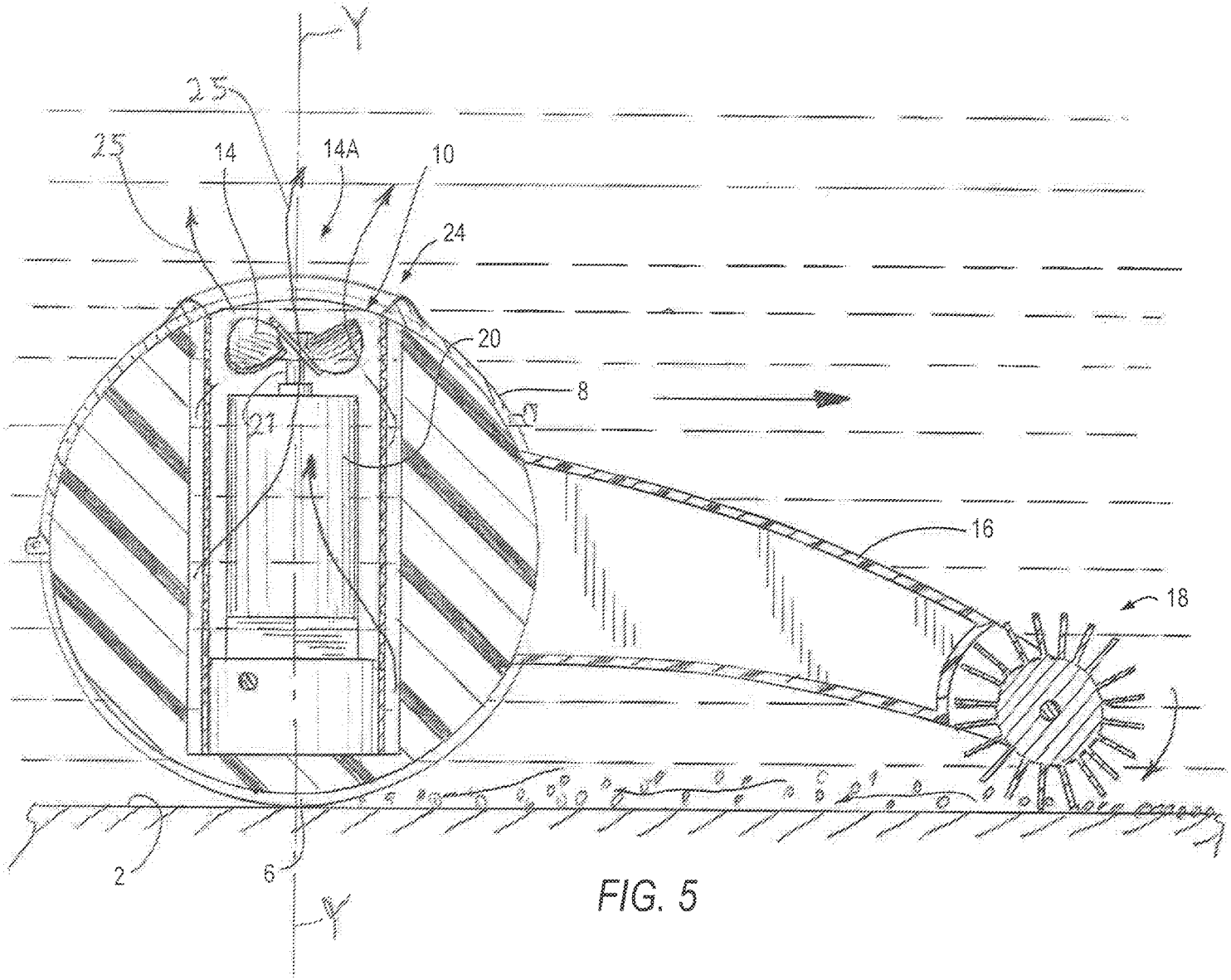
Figure 6:
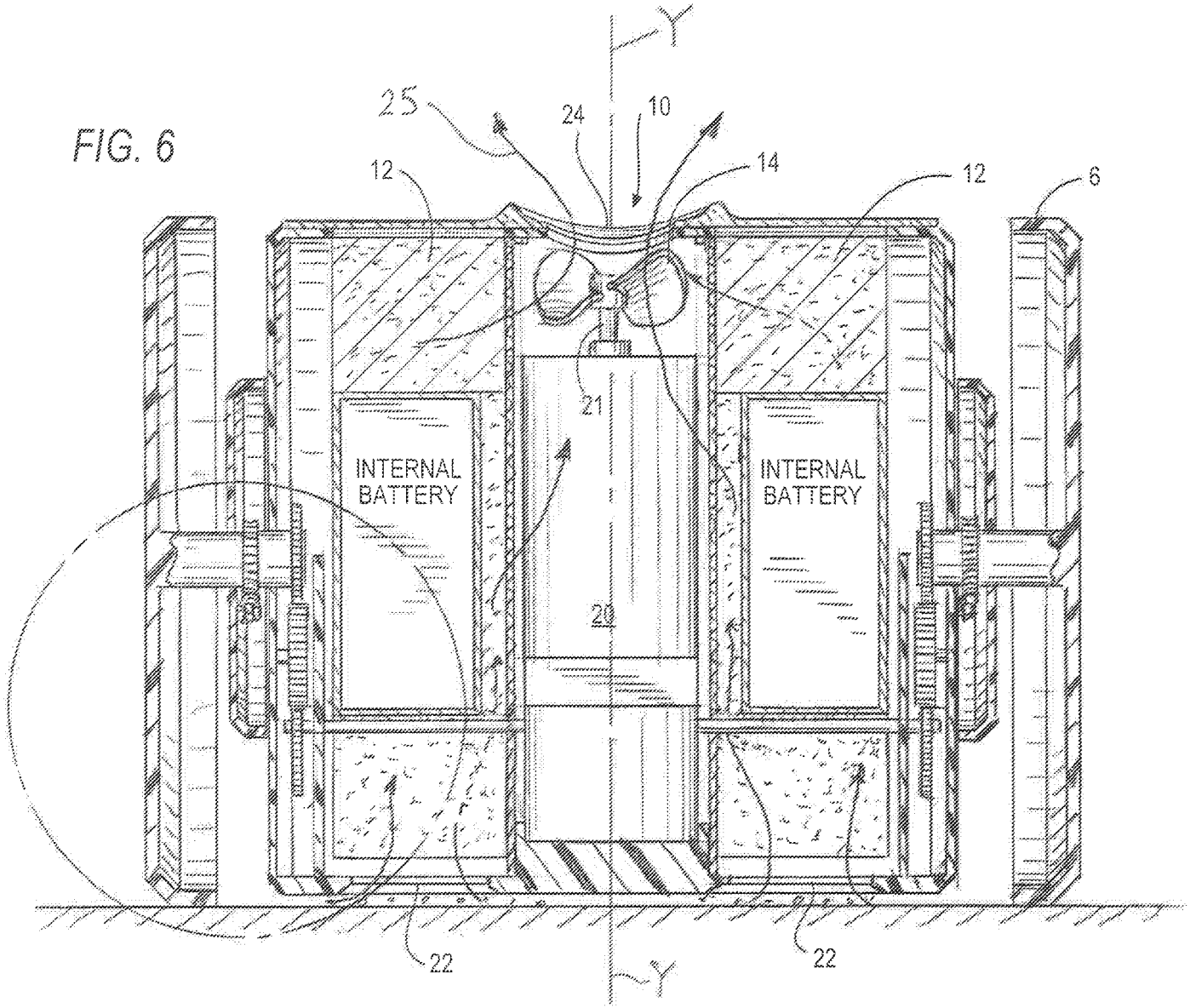
Figure 7:
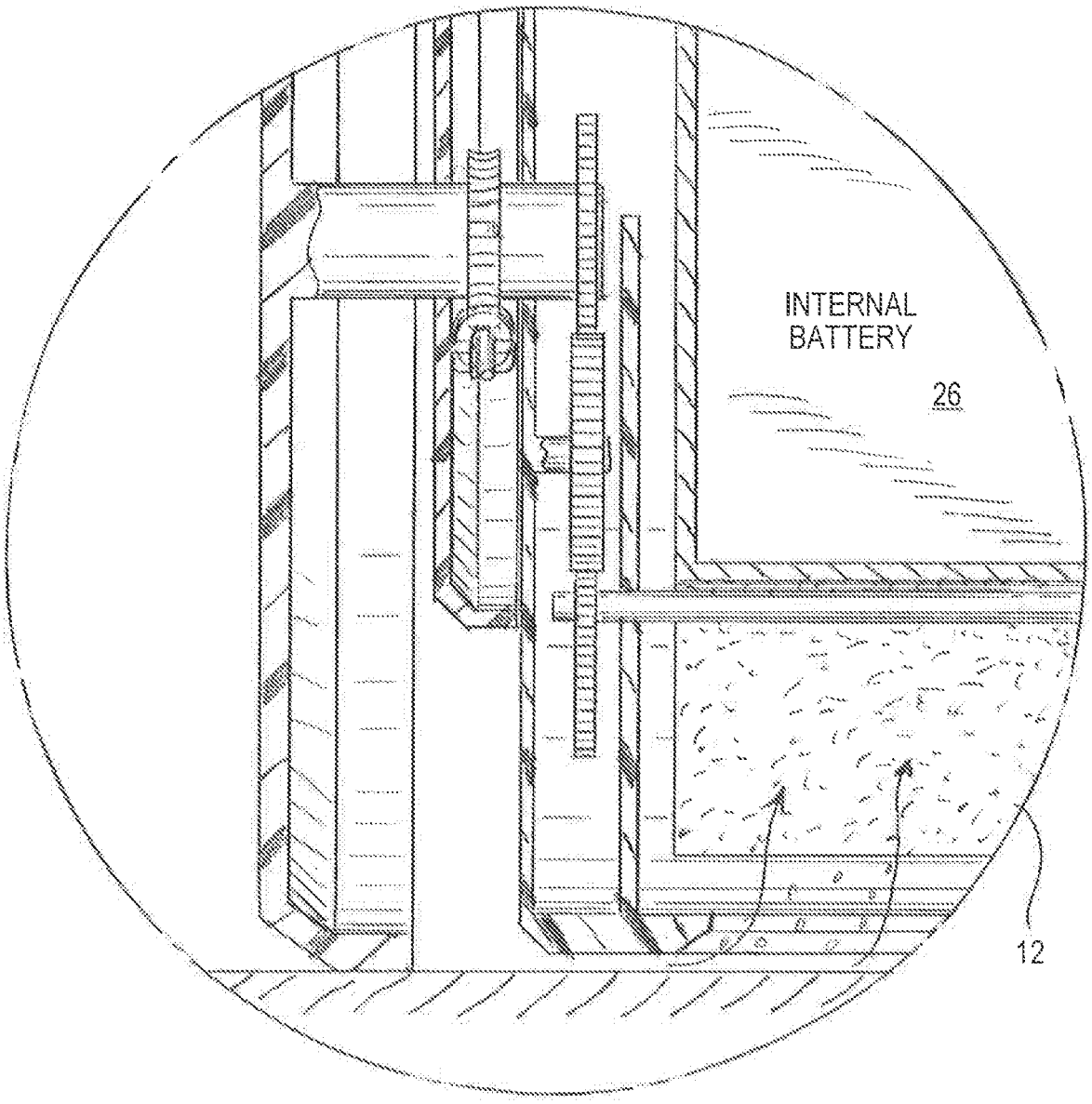
Figure 8:
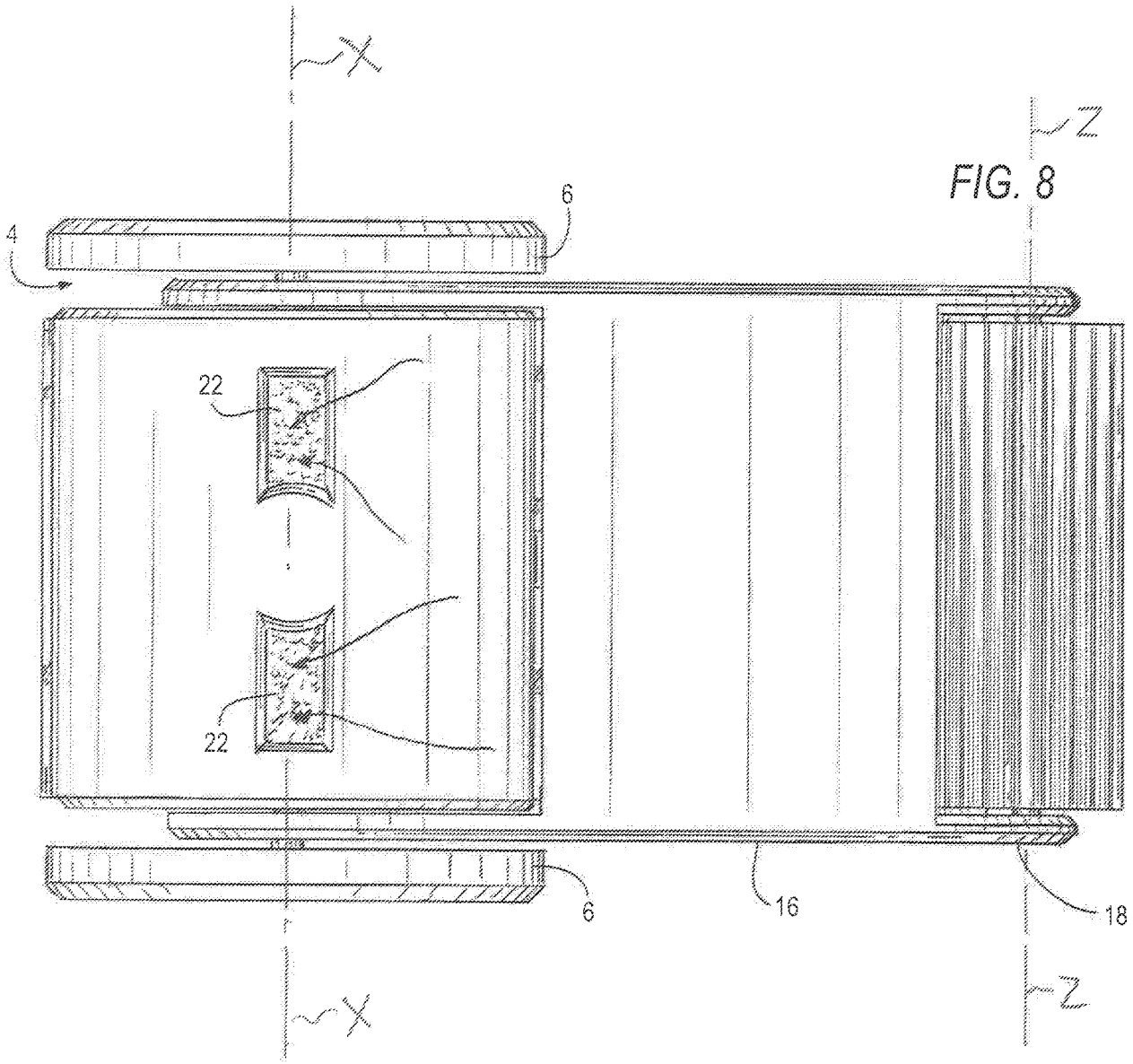
Figure 9:
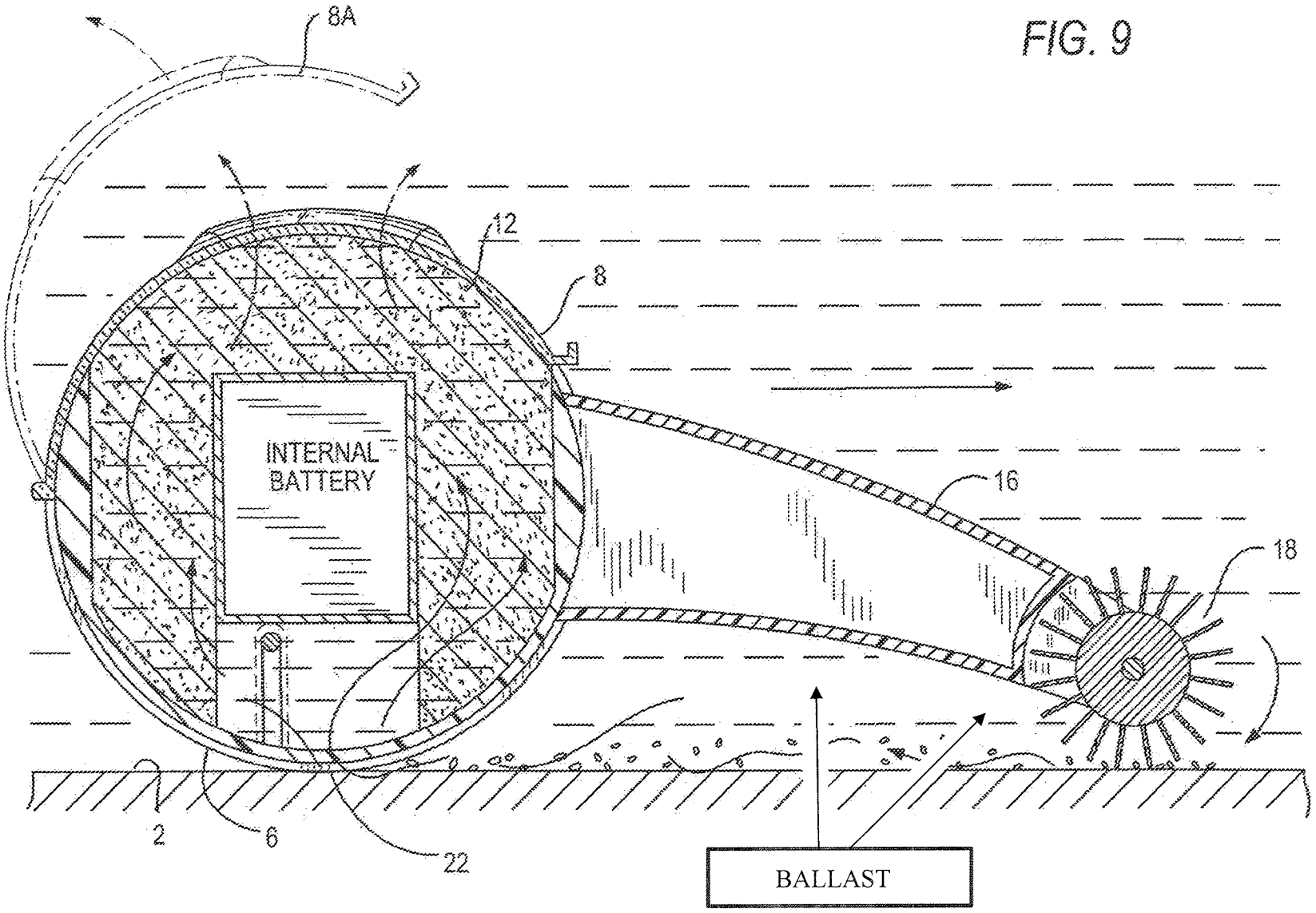
Figure 10:
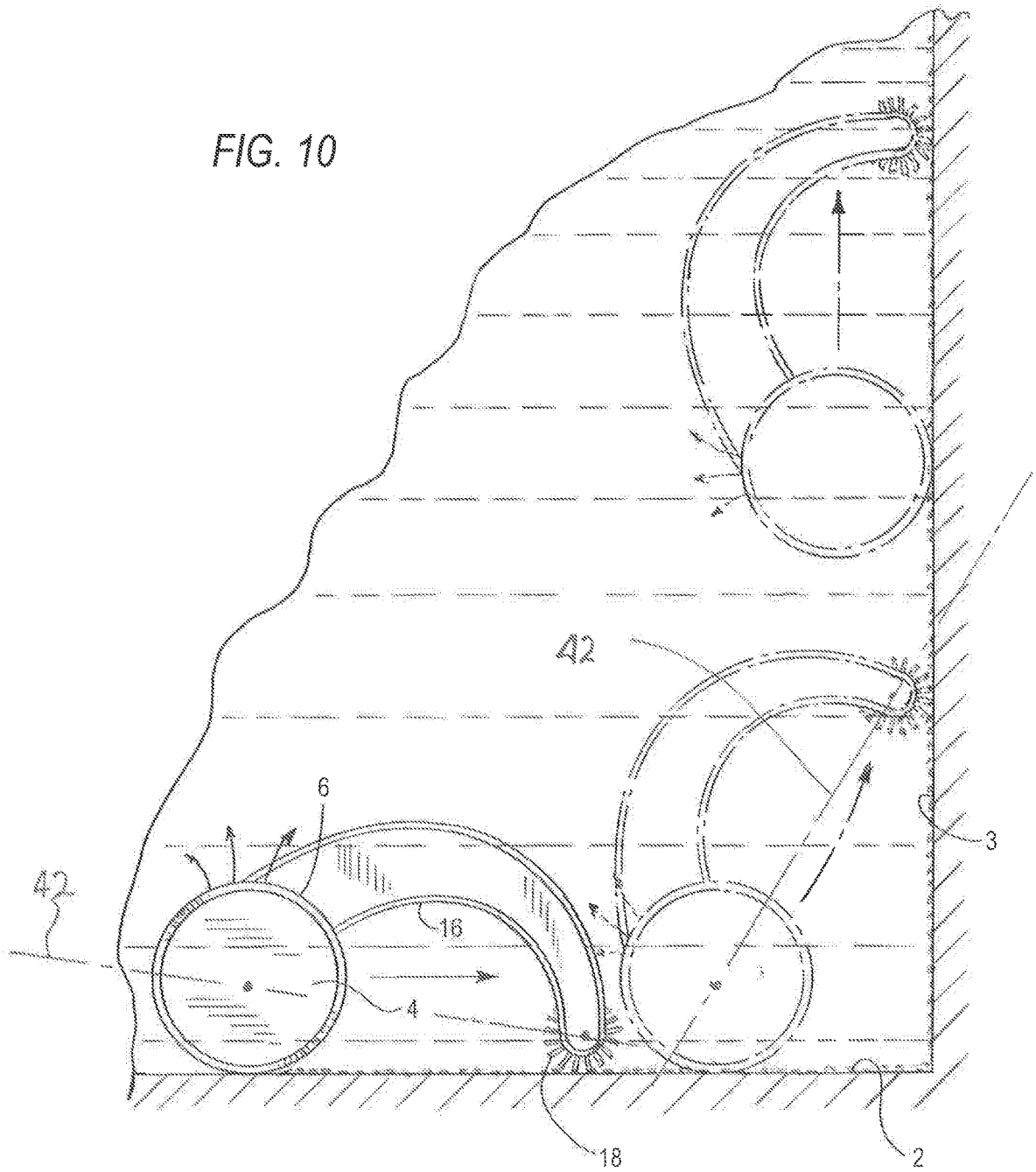
Figure 11:
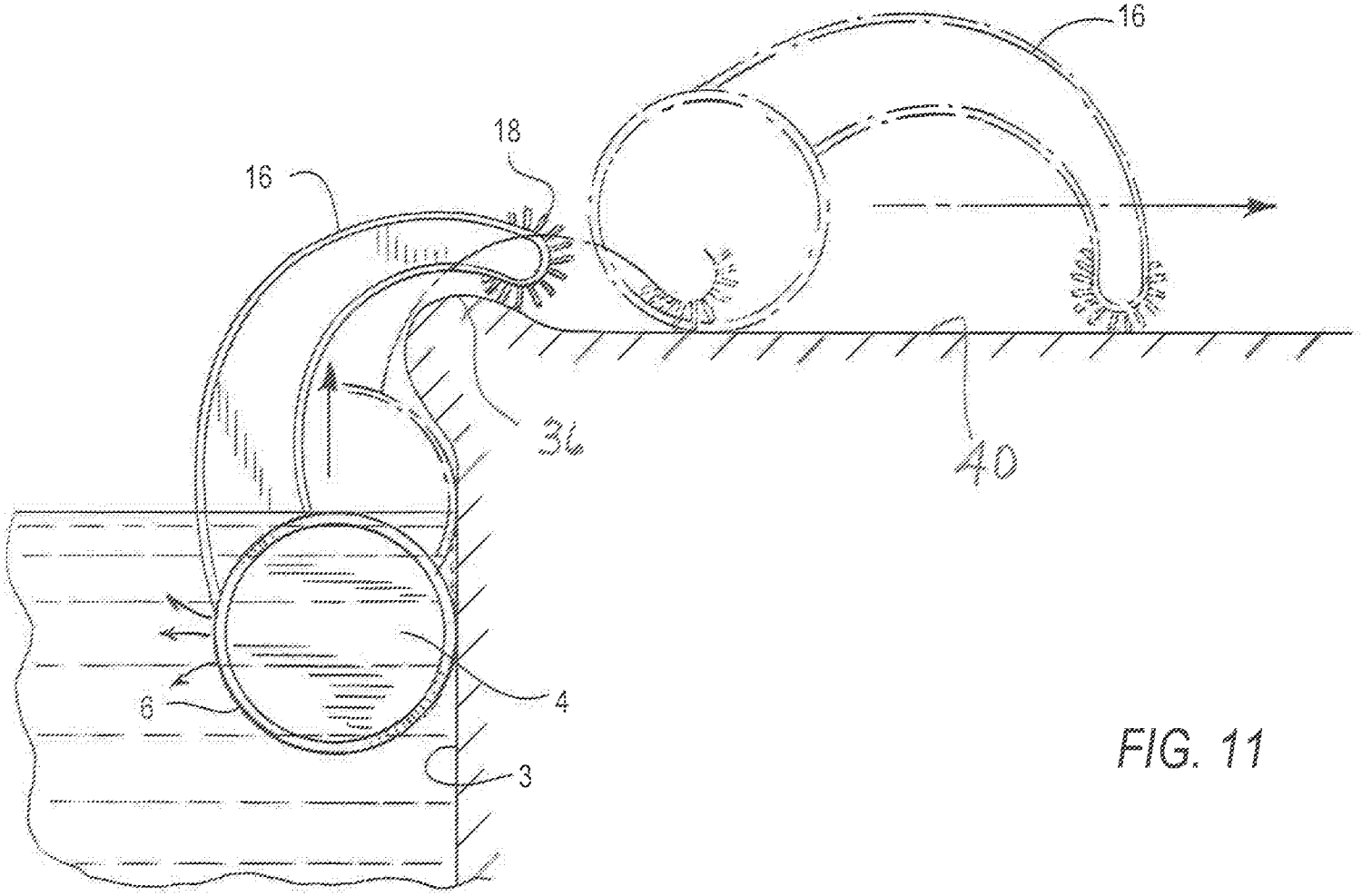

FIG. 1 is a top front perspective view of the robotic pool cleaner of the present invention, FIG. 2 is a top plan view thereof showing the pump and filters, FIG. 3 is a cross-sectional view taken along line 3-3 in FIG. 2, showing the drive coupling for the extended brush, FIG. 4 is a cross-sectional view taken along line 4-4 in FIG. 2, showing the drive coupling for the extended brush, FIG. 5 is a cross-sectional view taken along line 5-5 in FIG. 2, showing the motor and pump within the robotic pool cleaner housing, FIG. 6 is a cross-sectional view taken along line 6-6 in FIG. 2 showing the internal battery, motor and pump, FIG. 7 is an enlarged view of the gear drive train shown in FIG. 6, FIG. 8 is a bottom plan view of the apparatus shown in FIGS. 1 and 2, FIG. 9 is a cross-sectional view taken along line 9-9 in FIG. 2, showing the path of debris flow into and through the robotic pool cleaner, FIG. 10 is an elevation view of the robotic pool cleaner of FIG. 1 traveling on the pool floor and then up the pool wall, and FIG. 11 is an elevation view of the robotic pool cleaner climbing over the coping of the pool wall.

To further facilitate an understanding of the invention the same reference numerals have been used when appropriate to designate the same or similar elements that are common to the Figures. Unless otherwise indicated, the structures shown in the Figures are not drawn to scale, but are shown for illustrative purposes only.

DETAILED DESCRIPTION OF THE PREFERRED EMBODIMENT

The new pool cleaner is described below in terms of its component parts and sub-systems as follows:

A. Overview
B. Housing
C. Filters
D. Pump and motor
B. Extended brush subassembly
F. Motor drive system A. Overview FIG. 1 shows a first embodiment of the new robotic pool cleaner 1, and FIG. 3 shows this cleaner traversing the bottom or floor surface 2 of a pool. FIG. 10 shows the cleaner 1 in its horizontal travel mode along the floor of a pool, and then shows its ascent up the sidewall 3 of the pool.

B. Housing

The pool cleaner 1 in FIG. 1 includes generally cylindrical housing 4 which in the upright orientation shown, extends about its central horizontal axis X. Pool cleaner 1 further includes transport wheels 6, pivotable cover 8, (the cover in open position shown in dotted line 8A), central chamber 10, filters 12, pump propeller 14 of pump 14A, brush support arm 16 and rotary brush 18.

As seen in FIGS. 5 and 6 central chamber 10 in housing 4 contains electric motor 20 that rotates pump propeller 14 which functions as the water pump 14A Central chamber 10 extends along a second axis Y that is perpendicular to said above-mentioned housing central axis X.

Below central chamber 10 are intake ports 22 (see FIGS. 8 and 9) for suctioning in water drawn by pump 14A, which water is directed through filter cartridges 12 (see FIGS. 1 and 9) and then into central chamber 10, ejected out of top outlet or exhaust aperture 24 of housing 4 as a water jet 25 (see FIGS. 5, 6 and 9). One or more batteries 26 (see FIG. 6) for powering electric motor 20 may be situated below the motor or elsewhere in the housing. Alternatively, electrical power can be provided by an external power supply and power cable in a well-known manner.

FIG. 1 shows cover 8 in solid line and pivoted to an open position shown by dashed line 8A, whereby filter cartridges 12 are exposed and accessible for removal for cleaning or maintenance activities. Cover 8 is preferably transparent: so that a user can see through the cover to observe the condition of the filters and how full with debris they are. Cover 8 also has aperture 28 that is situated directly above pump 14A when the cover is closed so that the pump can expel filtered water through cover aperture 28 and back into the pool.

FIGS. 1, 2 and 8 show brush support arm 16 with brush 18 rotatable about axis Z which is parallel to housing central axis X. Brush 18 is formed preferably of fins 18A (see FIGS. 1, 3, 4 and 9) that extend parallel with the brush's rotary axis Z and have frictional surfaces that not only stir and dislodged debris on the pool floor 2, but help propel the pool cleaner up a sidewall and out of the pool, as will be described below in fuller detail. Brush 18 and transport wheels 6 are rotated simultaneously by motor 20 (as will be discussed below), so that brush 18 and wheels 6 cooperate in propelling the pool cleaner. Also shown in FIG. 8 is a rear support member 50 which will prevent the cleaner from tipping over backward. The rear support member 50 can be a rotatable wheel, a foot, protrusion and the like mounted on an extension 52 from the housing. Alternatively the support member 50 can be integral with the lower portion of the housing.

C. Filters

As seen in FIGS. 1, 2, 5 and 6, there is at least 1 and preferably 2 spaced apart filter assemblies (e.g. cartridges 12, baskets, bags and the like) situated in housing 4 in the flow path of water from housing inlet ports 22 to central pump chamber 10, after which filtered water from the filter cartridges is ejected through housing outlet 24 at the top of the housing (see arrows 25 in FIGS. 5 and 6).

D. Pump and Electric Motor Drive

In the embodiment shown (see FIGS. 5 and 6) electric motor 20 is oriented with a rotary driveshaft 21 along the Y axis which is perpendicular to the rotation axis X of wheels 6. The top end of motor shaft 21 rotates propeller 14. Through still further gears or other transmission conversion, such as an elongated flexible shaft 30 (see FIG. 3), motor 20 drives rotation of brush 18 at the distal end of brush's support arm 16. As will be described in further detail below, the rotary power transmission from motor 20 to brush 18 may be via a straight driveshaft 30 (FIG. 3), or a flexible drive shaft coupled to a worm gear, or via an arrangement of belts and pulleys (not shown), in one embodiment the interior chamber can also extend into the support arm and can have a panel to provide access there into.

E. Extended Brush

As partially described above, brush 18 rotates about axis Z that is parallel to central axis X that extends through cylindrical housing 4 and through the transport wheels 6. Brush 18, while it may comprise bristles or elongated fins 18A, defines a generally circular cylindrical body. Fins of a brush as seen in end view (FIGS. 3-5) extend generally radially outward as spokes of a wheel. Brush support arm 16 is mounted pivotally to housing 4, such that it can deflect away from the pool surface, for example upward by about 30°, but will return to its normal position as urged by spring element 32 illustratively shown in FIG. 3. Thus, support arm 16 can deflect for pool cleaner 1 to accommodate bumps or other obstacles in the path of travel, and also can deflect when the cleaner is climbing a vertical or inclined wall and over the coping as seen in FIG. 11. By spring element 32 support arm 16 is biased to its normal or downward position for contacting and sweeping a pool surface, but is deflectable away from such surface.

F. Motor Drive System

The motor drive system comprises electric motor 20 powered by batteries 26 which may be rechargeable from an electric power source or replaceable, or may be solar powered as described in further detail below. Alternatively the motor drive system can be powered by an external power source such as a power cable.

The motor's driveshaft 21 extends along vertical axis Y, through housing 4 with its top end coupled to and rotating propellers 14 of pump 14A, and a lower end coupled to gears or to other transmission means to drive transport wheels 6 about said axis X extending through housing 4, as seen in FIG. 7. Via gearing or other transmission means, the motor transmits power also along driveshaft 30 in support arm 16 to brush 18. As noted above, power transmission from motor driveshaft 30 to brush 18 may be via worm gears at each end of the driveshaft 30 or by other transmission arrangements.

G. Robotic Cleaner Climbing Out of Pool

A further feature of the present pool cleaner is its ability after climbing up a vertical wall, to continue and climb out of the pool as illustrated in FIGS. 10 and 11. The vertical climb up wall 3 is achieved in part because the cleaner's suction pulling water into the bottom of the housing, simultaneously pulls the housing toward the wall, thus surging wheels 6 to remain in frictional engagement with the wall surface Furthermore, the water being ejected out of the upper portion outlet 24 in the form of a water jet creates an oppositely directed force further urging housing 4 toward and against pool wall 3. With these forces urging the housing toward the wall, the main drive wheels 6 with their friction surfaces are able to drive the cleaner upward.

Brush, 18 rotating similarly as transport wheels 6, assists the wheels 6 in the climb. As long as the housing is below the water surface it will be suctioning water and creating the above-mentioned water jet. However, the combination of suction at the inlet 22 and the water jet at the outlet urges wheels 6 against wall 3 and enhances traction of the wheels on the pool surfaces. After the housing rises above the water level, the suction at the inlet 22 will draw in air instead of water, and the water jet at the outlet will cease. However, at this elevation of the housing, brush support arm 16 will have reached the top edge or coping 36 of the pool as the brush continues to rotate with its traction surfaces (fins) engaging the pool wall, coping 36 and deck surface 40, thereby pulling the cleaner out of the pool.

Brush arm 16 is deflectable (see also FIG. 3) and in one embodiment is configured with a curvature or arch to help the brush climb up and over the pool edge or coping without: the housing tipping backward. In FIGS. 1-9 support arm 16 is shown with a mild curvature to illustrate the general concept of a forward extending arm 16 supporting rotary brush 18. To enhance the robotic cleaner's ability to climb out of the pool, a support arm with a higher arch than is disclosed in FIGS. 10-11, which illustrate a particular embodiment where arm 16A is longer and/or defines a higher arch. Arm 16A could have a length as shown and defined in an arc based on a radius of one to two feet for example. Length and curvature of arm 16 may vary while retaining the feasibility for brush 18 to climb over the coping and to reach the pool deck surface 40, while cleaner housing is still adjacent the pool wall. Then, brush elements 18A can drive forward and pull the cleaner housing further upward and over the coping. As seen in FIG. 11, line 42 represents a plane extending through the axes of rotation of said wheels 6 and brush 18. Arm 16A is formed as an arch that rises above said plane.

To still further assist the cleaner to climb out of the pool, support arm 16 may have added weight in its distal portion to move the center gravity closer to the brush 18 when the brush has climbed over the coping, i.e. away from the water. Alternatively, additional weight may be included in the lower portion of the housing as by location of batteries, or by a particular chamber for water or by other ballast alternative, to maintain the center of gravity toward the wall as the cleaner is climbing up and over the coping.

H. Computer Program

The pool cleaner 1 is responsive to command signals from a controller which controls the cleaning operations of the pool. The controller is preferably a micro-controller that can be installed on-board the pool cleaner. Alternatively, the controller can be installed in an external power supply from which control signals are sent over a power cable electrically coupled between the external power supply and the cleaning device 10. The controller generally includes a micro-controller or micro-processor, one or more input/output (I/O interfaces, support circuitry, as well as memory for storing various operational and cleaning programs. Communications between the various microcontroller components are facilitated via one or more bus lines.

The processor cooperates with conventional support circuitry, such as power supplies, clock circuits, cache memory and the like, as well as circuits that assist in executing software routines stored in the memory. The memory can be a single memory device or separate memory devices that function as program storage and data storage. The program storage can include one or more cleaning pattern routines and other operational routines. The cleaning pattern routines can be preinstalled by the manufacturer with different cleaning patterns and/or durations, and thereafter selectable by the end-user. The data storage can include user-input data, such as dimensions/configuration of the pool for which the pool cleaner will be used, as well as sensor data, and the like. It is contemplated that some of the process steps discussed herein as software processes can be implemented within hardware, for example, as circuitry that cooperates with the processor to perform various steps. In one embodiment, the micro-processor executes a cleaning pattern routine using the pool dimension/configuration data previously inputted into the memory by a field technician or end-user.

Although the controller discussed as being a microcontroller or a general-purpose computer that is programmed to perform various defined and/or control functions for specific purposes in accordance with the present invention, the invention can be implemented in hardware such as, for example, an application specific integrated circuit (ASIC). As such, it is intended that the processes described herein be broadly interpreted as being equivalently performed by software, hardware, or a combination thereof. Reference is made for incorporation herein by reference of co-pending application PCT/US16/35251 filed Jun. 1, 2016 owned by the assignee of the present application, for additional disclosure of a micro-controller and system that may be incorporated into the present pool cleaner invention.

While the invention has been described in conjunction with several embodiments, it is understood that many alternatives, modifications and variations will be apparent to those skilled in the art in light of the foregoing description. Accordingly, this invention is intended to embrace all such alternatives, modifications and variations which fall within the spirit and scope of the claims.

We claim:

1. A self-propelled swimming pool cleaner comprising:

a. a housing (i) defining a central axis, (ii) comprising at least one intake port and at least one exhaust aperture, and (iii) comprising a first end and a second end opposite the first end;

b. a brush support extending forward of the housing when the housing is travelling in a forward direction;

c. a brush (i) connected to the brush support and (ii) configured to rotate about a rotary axis parallel to, and spaced from, the central axis;

d. a filter;

e. a pump configured to draw water from a swimming pool through the at least one intake port and the filter for exhaustion through the at least one exhaust aperture into the swimming pool, wherein the filter and the pump are within an internal chamber of the housing; and f. wherein the self-propelled swimming pool cleaner consists of two wheels, wherein a first wheel of the two wheels is supported at the first end of the housing and a second wheel of the two wheels is supported at the second end of the housing.

2. A self-propelled swimming pool cleaner comprising:

a. a generally cylindrical housing (i) defining a central axis and (ii) comprising at least one intake port, wherein the generally cylindrical housing defines an internal chamber, wherein a pump and a motor are contained within the internal chamber of the generally cylindrical housing, wherein the pump is configured to draw water from a swimming pool through the at least one intake port, and wherein the generally cylindrical housing comprises a width defined in a direction parallel to the central axis that is greater than a front-to-back length of the generally cylindrical housing defined in a direction perpendicular to the central axis;

b. a brush support extending forward of the generally cylindrical housing when the generally cylindrical housing is travelling in a forward direction;

c. a brush (i) connected to the brush support and (ii) configured to rotate about a rotary axis parallel to, and spaced from, the central axis; and d. wherein the self-propelled swimming pool cleaner consists of two wheels, wherein a first wheel of the two wheels is at a first end of the housing and a second wheel of the two wheels is at a second end of the housing.

3. A cleaner according to claim 2 in which the brush support comprises an arm configured to pivot relative to the housing.

4. A cleaner according to claim 2 in which the brush comprises fins extending parallel to the rotary axis.

5. A cleaner according to claim 2 further comprising a filter positioned at least partially in the housing in use, at wherein the pump is configured to draw water from a swimming pool through the at least one intake port and the filter.

6. A cleaner according to claim 2, wherein the brush and brush support define a brush assembly comprising a brush assembly width in a direction transverse to the forward direction, wherein the brush assembly width is greater than a width of the generally cylindrical housing in the direction transverse to the forward direction.

7. A cleaner according to claim 2, wherein the brush is deflectable relative to the housing and the cleaner is configured to transition from a horizontal surface to a vertical surface and to climb the vertical surface during cleaning.

* * * * *